United States Patent [19]

Kitamura et al.

[11] 4,314,469

[45] Feb. 9, 1982

[54] ROLLING MILL

[75] Inventors: Takashi Kitamura; Yoshiro Sumi; Akira Matsufuji, all of Kitakyushu, all of Japan

[73] Assignee: Nippon Steel Corporation, Tokyo, Japan

[21] Appl. No.: 145,386

[22] Filed: Apr. 30, 1980

[30] Foreign Application Priority Data

May 4, 1979 [JP] Japan ..... 54/54071

[51] Int. Cl.[3] ..... B21B 1/14; B21B 31/06; B21B 31/18

[52] U.S. Cl. ..... 72/221; 72/247; 72/237

[58] Field of Search ..... 72/221, 188, 226, 238, 72/239, 247, 237, 224

[56] References Cited

U.S. PATENT DOCUMENTS

| | | | |
|---|---|---|---|
| 1,878,595 | 9/1932 | Moller | 72/221 |
| 3,355,923 | 12/1967 | Gillet | 72/224 |
| 3,800,648 | 4/1974 | Nishigori et al. | 72/239 X |
| 4,184,353 | 1/1980 | Sebardt et al. | 72/221 |

*Primary Examiner*—Milton S. Mehr
*Attorney, Agent, or Firm*—Kenyon & Kenyon

[57] ABSTRACT

A rolling mill comprising a roll stand which supports rolls provided with roll passes for rolling a blank to be rolled which is fed along a rolling line, the roll stand being supported on a stationary base so as to move in axial directions of the rolls perpendicular to the rolling line, wherein the roll stand is provided with rotatable eccentric rods which have rotatable wheels thereon, the rods being rotated to occupy a non-operation position in which the wheels are separated from the base and an operational position in which the wheels contact with the base so as to rotate on the base, thereby to carry the roll stand in axial directions of the rolls.

4 Claims, 4 Drawing Figures

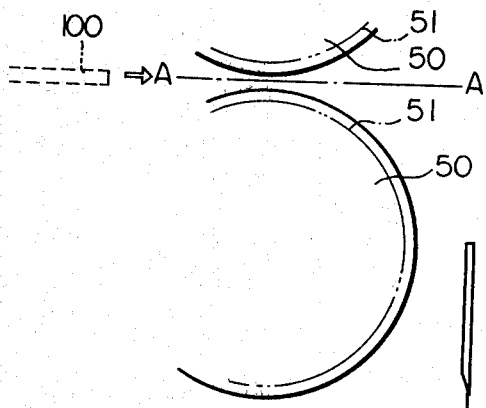
Fig. 1
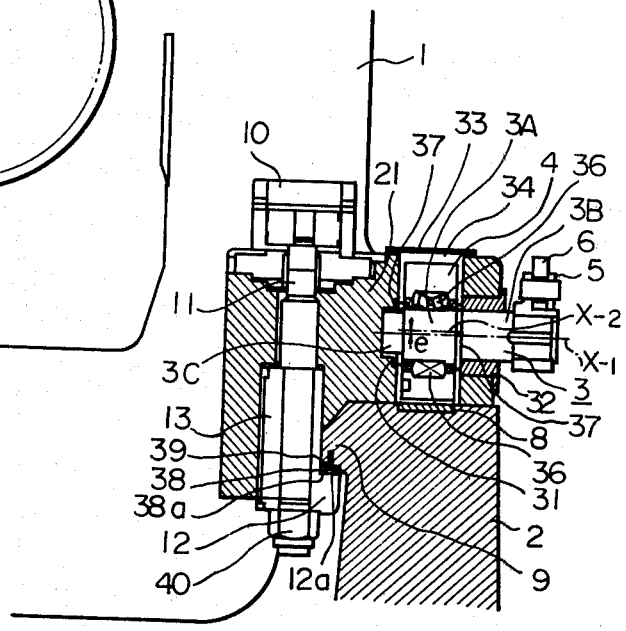
Fig. 2
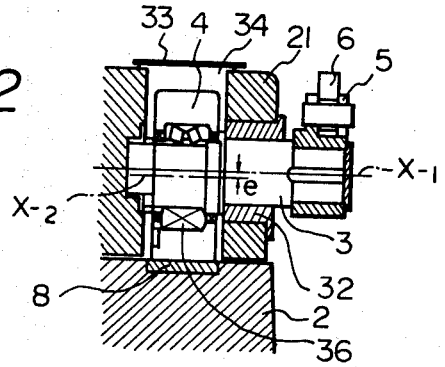

ROLLING MILL

This invention relates to a rolling mill for shape steels, such as structural and other shapes, or railroad-rails, in which the mill can be moved in directions perpendicular to a rolling line along and on which rolling is carried out, when roll passes are required to be changed every stroke of rolling, so that the shape steels can be always rolled on the same rolling line.

There is known a reversing rolling mill in which rolls incorporated in an immovable roll stand are provided with a plurality of roll passes which are located side by side in a direction perpendicular to rolling lines. In such a mill, when the blank which is to be rolled and which has been rolled in one roll pass is brought into an adjacent roll pass, the blank is moved on a roller table on which the blank is supported, in a direction perpendicular to the roll pass. That is, after being rolled in a first roll pass, the blank is laterally moved on the roller table by means of a transversal drive to bring the blank to a position where it is in alignment with an adjacent second roll pass. This can be repeated to successively roll the blank in side by side-arranged roll passes. When the blank is rolled in the second roll pass, the blank is fed in the opposite direction to the direction in which the blank is fed when rolled in the first roll pass.

The above mentioned known type of reversing rolling mill has an advantage in that the cost of equipment is lower than that of a conventional continuous arrangement of rolling mills, since different roll passes can be provided in one reversing rolling mill. However, such a reversing mill requires a large or wide roller table. Furthermore, the reversing mill has a serious drawback in that rolled products tend to be damaged or deformed during the transversal movement of the products, resulting in undesirable abrasions or scratches on outer surfaces of the products.

In order to solve the above mentioned drawback, it has been proposed to move the roll stand in a direction perpendicular to the rolling line, i.e., in a direction along the length of the rolls, instead of the transversal movement of the blank to be rolled, so that the blank can be reciprocally moved and rolled on the same rolling line. In this newly proposed reversing mill, a relatively heavy roll stand must be rapidly and transversely moved prior to a reverse movement of the blank. This results in an increase in the possibility of galling of a sliding portion of the rolling mill. Furthermore, it is very difficult to achieve an exact and smooth movement of the mill in a very short period of time.

In order to solve the problem of the increase of the possibility of galling and to achieve an exact and smooth movement of the mill, there has been proposed a reversing mill as disclosed in Japanese Patent Publication No. 47-37831, in which a housing of the mill has, on its leg portions, transverse wheels which can rotate on a base which has frames and which extends perpendicular to the rolling line, so that the mill can be transversely moved on the base. In the base frames there are arranged mill lifting beams located below the transverse wheels and beam lifting cylinders connected to the beams. When the mill is transversely moved, clamp devices which are provided on the leg portions of the housing to immovably lock the mill to the base are released, the beams are raised by the beam lifting cylinders and the mill is moved in a direction perpendicular to the rolling line.

However, in the rolling mill disclosed in the Japanese Patent Publication mentioned above, since the weight of the mill, when raised, must be supported by the mill lifting beams, the latter must be very rigid, which necessitates large size beams and, as a result, the base frame must be large to support the large beams. Furthermore, due to the heavy mill lifting beams arranged in the corresponding base frames, maintenance of the mill is difficult.

The object of the present invention is to eliminate the above mentioned drawbacks by providing a light and compact rolling mill in which the maintenace can be easily effected and in which the body of the mill can be rapidly moved in directions perpendicular to the rolling line.

According to the present invention, there is provided a rolling mill comprising a roll stand which supports rolls provided with roll passes for rolling a blank to be rolled which is fed along a rolling line, said roll stand being supported on a stationary base so as to move in axial directions of the rolls perpendicular to the rolling line, wherein said mill comprises a drive connected to the roll stand for moving the roll stand in said axial directions, and rotatable wheels which are provided in the roll stand and which are selectively brought into contact with the stationary base so as to carry the roll stand on the stationary base.

The invention will be discussed in detail below, with reference to the accompanying drawings which illustrate a preferred embodiment of the invention and in which:

FIG. 1 is a partially sectioned partial front elevational view of a rolling mill according to the present invention;

FIG. 2 is a sectional view of an eccentric rod mechanism in FIG. 1 shown in a different position;

Figure 3:
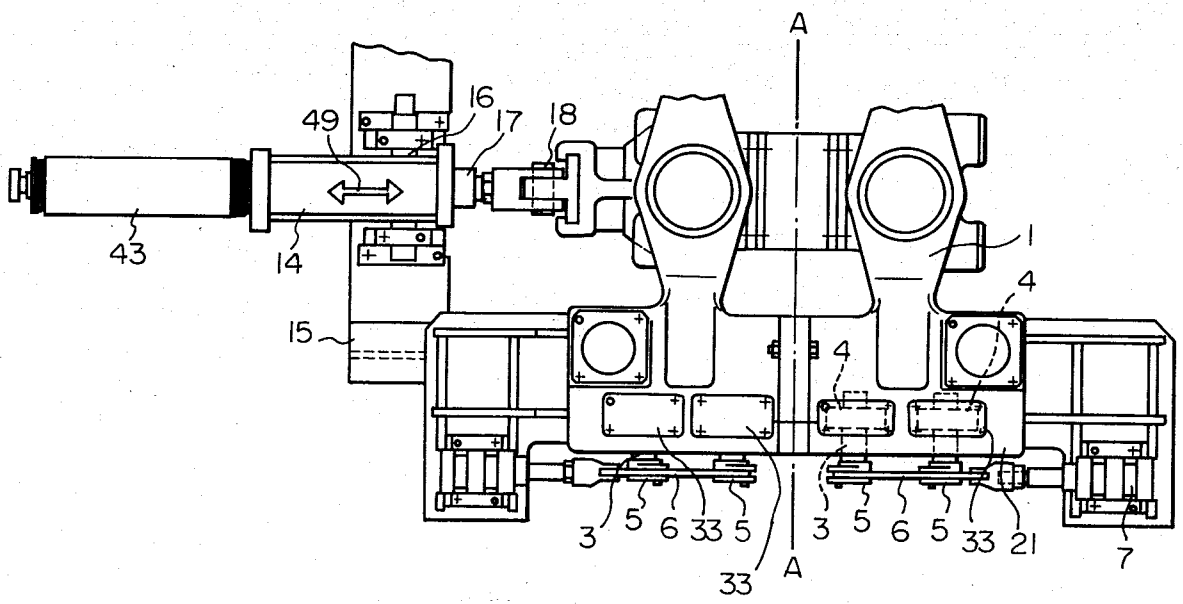
FIG. 3 is a plan view of FIG. 1, with the rolls removed.
Figure 4:
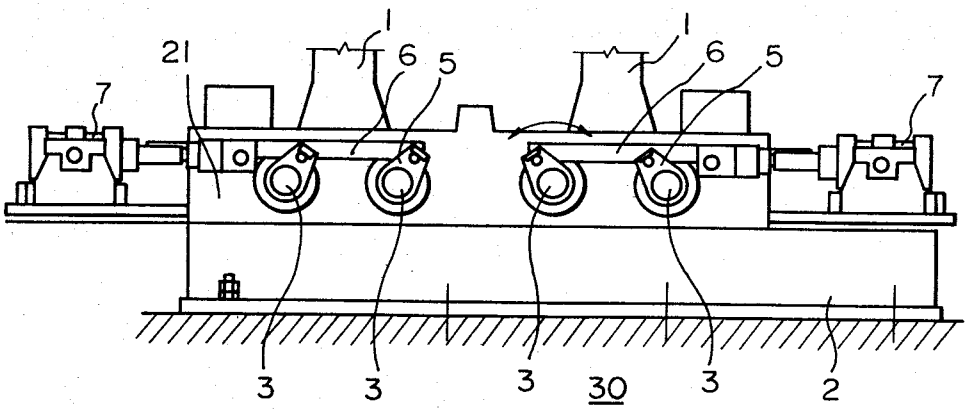
FIG. 4 is a side elevational view of FIG. 1, with the rolls removed.

Working rolls 50, 50 having a plurality of roll passes 51 (FIG. 1) are supported by and in a roll stand 1 of a mill to roll a blank 100 to be rolled, such as a rail or other shape steel, which is fed along a rolling line A—A (FIGS. 1 and 3). The roll stand 1 is located and supported on two parallel base frames 2 (only one base frame is illustrated in FIGS. 1 and 4) which are secured to a base 30 (FIG. 4) such as a floor. The two base frames 2 extend perpendicular to the rolling line A—A and are provided on opposite sides of the roll stand 1.

Referring to FIG. 1, the roll stand 1 has, at its lower portion, a pair of legs 21 only one of which is shown, integral therewith which are located on the respective base frames 2. In each leg 21 there are provided two pairs of eccentric rods 3, each having an outer end 3B protruding out of the leg. Each eccentric rod 3 has an eccentric portion 3A having a center axis $X_{-2}$ which is eccentric by "e" to a center axis $X_{-1}$ of the rod 3. An inner end 3C and the outer end 3B of each rod 3 are rotatably supported by bearings 31 and 32, which are provided in the leg 21, respectively. In each leg 21 there are formed two pairs of vertical holes 34 which are covered, at their upper ends, by cover plates 33 secured to the legs 21. The vertical holes 34 receive traverse wheels 4 which are rotatably supported on the eccentric portions 3A of the eccentric rod 3 by means of bearings 36, which are tapered roller bearings in the illustrated embodiment. The axial movement of the wheels 4 can be prevented by spacers 37, 37. The wheels 4 in each instance rotates on the respective eccentric portions 3A of the rods concentrically 3 about the axes $X_{-2}$ of the eccentric portions 3A. Actuating arms 5 are keyed onto the outer ends 3B of the rods 3. Each pair of arms 5 are interconnected by means of piston rods 6 which are, in turn, connected to pistons (not shown) arranged in hydraulic cylinders 7 (FIGS. 3 and 4) which are supported by the legs 21. Consequently, the reciprocal movement of the piston rods 6 by the operation of the cylinders 7 is transmitted to the respective arms 5, so that each pair of eccentric rods 3 rotate in the same direction about the respective center axes $X_{-1}$. In order to easily and smoothly rotate the wheels 4 on the legs 21, liners 8 (FIGS. 1 and 2) may be provided in the upper portions of the legs 21 and are flush with the upper surface of the legs 21. The number of the liners 8 corresponds to that of the wheels 4 and is eight in the illustrated embodiment.

When each rod 3 begins to rotate from a non-operational position shown in FIG. 1, in which the center axis $X_{-2}$ of the eccentric portion 3A is located above the stationary center axis $X_{-1}$ of the rod 3 at a separation of "e" so that each wheel 4 is separated from the corresponding liner 8, the rod comes to an operational position shown in FIG. 2, in which the wheel 4 is in contact with the liner 8 and the center axis $X_{-2}$ is located below the center axis $X_{-1}$. The legs 21 are supported on and by the corresponding base frames 2 in the non-operational position in FIG. 1, and the legs 21 are supported on and by the wheels 4 in the operational position in FIG. 2. That is, when the rods 3 are rotated from the non-operational position in FIG. 1 to the operational position in FIG. 2 by the cylinders 7, the wheels 4 are lowered by the distance "2.e", so that the wheels 4 come in contact with the corresponding liners 8 to raise the legs 21 from the base frames 2.

Each base frame 2 has a projection 9 (FIG. 1) which protrudes toward the roll stand 1 and which is provided with a retainer 38 secured to the projection 9 by means of a screw 39. The retainer 38 has a lower contact surface 38A. In the legs 21 there are provided hydraulic cylinders 10, each having a piston rod 11 which is threaded at its lower end, to which end a lever 13 is connected by means of a nut 40. The lever 13 has a projection 12 protruding toward the corresponding base frame 2. The projection 12 has an upper contact surface 12A which can be frictionally engaged by the lower contact surface 38A of the retainer 38. When the upper contact surface 12A is brought into contact with the lower contact surface 38A, the legs 21 are immovably locked on or held by the base frames 2. The locked position is maintained during the rolling operation of the working rolls 50. When the cylinders 10 are operated to lower the piston rods 11 and, accordingly, the levers 13, the upper contact surfaces 12A of the projections 12 are separated from the corresponding lower contact surfaces 38A of the projections 9, so that the legs 21 are free from the base 2, that is, the legs 21 can move on the base frames 2.

The roll stand 1 is connected to a piston rod 17 of a hydraulic cylinder device 14 by means of a pivot joint 18, as illustrated in FIG. 3. The cylinder device 14 is rotatably held on a frame 15 which bridges the opposed base frames 2, by means of a pivot joint 16. The device 14 can be attached to the base frame 2, (not shown in FIG. 3), by means of a connecting rod 43. The piston rod 17 reciprocally moves in a direction perpendicular to the rolling line A—A to move the roll stand 1 together with the working rolls 50 (FIG. 1) in the same direction. The pivot joints 18 and 16 allow the roll stand 1 to smoothly move even when the joints are not located at the same height.

The rolling mill according to the present invention operates as follows.

The blank 100 (FIG. 1) to be rolled is fed in one roll pass 51 defined between the working rolls 50 to be subject to a first rolling operation. After that, the blank 100 is fed in an adjacent roll pass from a reverse direction to be subject to a second rolling operation. For this purpose, according to the present invention, the roll stand 1 is transversely moved together with the working rolls 50 without moving the blank 100, so that the adjacent roll pass for the second rolling is aligned with the rolling line A—A. In order to transversely move the roll stand 1, first, the cylinders 10 are actuated to lower the piston rods 11 and, accordingly, the levers 13. As a result of this, the upper contact surfaces 12A are separated from the corresponding lower contact surfaces 38A, so that the frictional lock mechanism therebetween is released. Then, the cylinders 7 are operated to move the rods 6, which cause the eccentric rods 3 to rotate, from the non-operational position in FIG. 1 to the operational position in FIG. 2, by means of the arms 5. Thus, the legs 21 are lifted over and separated from the base frames 2, and the wheels 4 are brought in contact with the corresponding liners 8. The cylinder device 14 is operated to rapidly move the roll stand 1 together with the working rolls 50 (FIG. 1) in the directions designated by an arrow 49 (FIG. 3) perpendicular to the rolling line A—A. After the roll stand 1 is moved a predtermined lateral distance so that the subsequent roll pass is brought on the rolling line A—A, the cylinders 7 are reversed to rotate the eccentric rods 3 in the reverse direction, thereby to again bring the wheels 4 and the legs 21 into the non-operational position in FIG. 1. Finally, the cylinders 10 are reversed to raise the levers 13 in order to again establish a frictional engagement connection between the upper and lower contact surfaces 12A and 38A. After that the blank is fed in the reverse direction and, thus, the second rolling can be carried out.

The cylinders 7 for lifting the roll stand 1 and the cylinder 14 for effecting the rapid and transverse movement of the roll stand 1 are not limited to hydraulic cylinders and can be replaced by pneumatic cylinders, electric motors or another power means, in accordance with operating conditions of the rolling mill. The rapid lateral movement of the roll stand can be stopped at a predetermined position by the provision of switching means, such as a limit switch and/or a stop, although such means is not illustrated in the drawings.

As can be understood from the above description, according to the present invention, the lateral displacement of the roll stand can be rapidly, precisely and smoothly carried out, so that since no lateral displacement of the blank is necessary, the products are free from undesirable abrasions and scratches which would otherwise be produced on the products, and the products are not bent. Furthermore, according to the present invention, it is possible to decrease the size of roller tables which are located before and behind the rolling mill, in comparison with a prior art. Finally, according to the present invention, the mechanism for lifting the roll stand is compact, thus resulting in a decrease of the cost of the equipment and in an easier maintenance of the rolling mill, in comparison with the prior arts described in the first part of this specification.

We claim:

1. A rolling mill comprising a roll stand which supports rolls provided with roll passes for rolling a blank to be rolled which reciprocally moves along a rolling line, said roll stand being supported on a stationary base so as to move in axial directions of the rolls perpendicular to the rolling line, wherein said mill comprises a drive connected to the roll stand for moving the roll stand in said axial directions, and rotatable wheels which are provided in the roll stand and which are selectively brought into contact with the stationary base so as to carry the roll stand on the stationary base; said mill further comprising rotatable eccentric rods which are provided in the roll stand and which support thereon the rotatable wheels, said eccentric rods being rotated to selectively occupy a non-operational position in which the wheels are separated from the stationary base, and an operational position in which the wheels are brought into contact with the stationary base and the roll stand is separated from the stationary base, so that the wheels can rotate on the stationary base to move the roll stand in said axial directions.

2. A rolling mill according to claim 1, wherein it further comprises at least one actuator connected to the eccentric rods for rotating the eccentric rods.

3. A rolling mill according to claim 2, wherein it further comprises locking means which are provided between the roll stand and the stationary base to immovably connected to the roll stand to the stationary base.

4. A rolling mill according to claim 3, wherein it further comprises at least one actuator for operating the locking means.

* * * * *

UNITED STATES PATENT AND TRADEMARK OFFICE

CERTIFICATE OF CORRECTION

PATENT NO. : 4,314,469
DATED : February 9, 1982
INVENTOR(S) : Takashi Kitamura, et al It is certified that error appears in the above—identified patent and that said Letters Patent is hereby corrected as shown below:

Col. 3, line 3, change "rods concentrically 3" to --rods 3 concentrically--.

Col. 3, line 66, change "frame" to --frames--.

Signed and Sealed this

First Day of June 1982

[SEAL]

*Attest:*

GERALD J. MOSSINGHOFF

*Attesting Officer*

*Commissioner of Patents and Trademarks*